United States Patent [19]

Sullivan

[11] 4,253,269

[45] Mar. 3, 1981

[54] REVERSIBLE FLEXIBLE AERODYNAMIC DISC

[76] Inventor: Richard A. Sullivan, P.O. Box 6, East Rutherford, N.J. 07073

[21] Appl. No.: 74,950

[22] Filed: Sep. 13, 1979

Related U.S. Application Data

[63] Continuation-in-part of Ser. No. 894,875, Apr. 10, 1978, abandoned.

[51] Int. Cl.[3] ..... A63H 27/00; A63B 65/00

[52] U.S. Cl. ..... 46/74 D; 273/424

[58] Field of Search ..... 46/74 D; 273/317, 424

[56] References Cited

U.S. PATENT DOCUMENTS

| | | | |
|---|---|---|---|
| 3,359,678 | 12/1967 | Headrick | 46/74 D |
| 3,566,532 | 3/1971 | Wilson | 46/74 D |
| 4,153,252 | 5/1979 | Sullivan | 46/74 D |

*Primary Examiner*—F. Barry Shay
*Assistant Examiner*—Michael J. Foycik, Jr.
*Attorney, Agent, or Firm*—Haseltine and Lake

[57] ABSTRACT

A reversible aerodynamic disc-shaped object is provided, shaped as a disc, an outer rim section attached to the periphery of the disc, and a central section disposed within the center of the disc, wherein the central section contains a substantial amount of the weight of the disc-shaped object for increasing the rotational spin of the object.

The aerodynamic disc-shaped object may be reversible wherein the disc is of a thin, flexible membrane and the rim section extends from both sides of the periphery of the disc, the rim section being of sufficient weight to create an arcuate cross-sectional configuration in the disc-shaped object when the same is airborne, independent of the side of the disc-shaped object that is facing up.

10 Claims, 7 Drawing Figures

FIG. 3
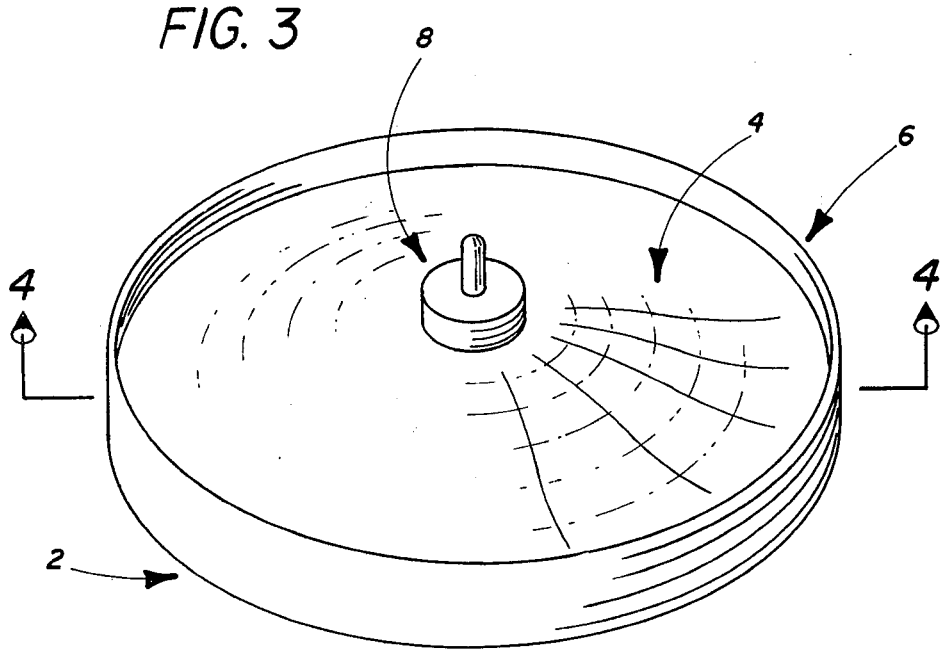
FIG. 4
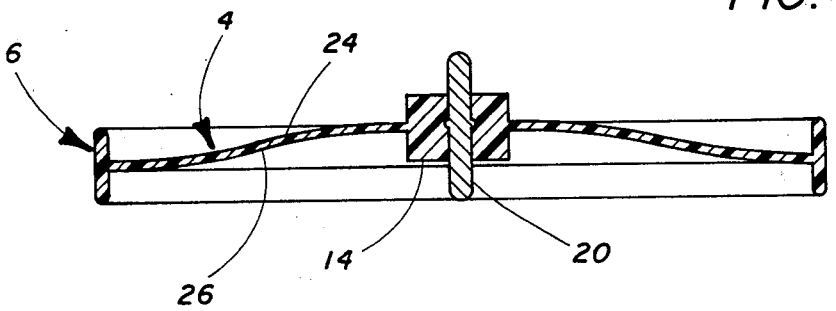
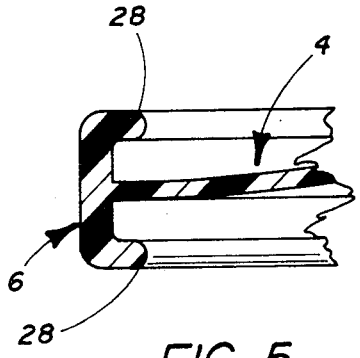
FIG. 5
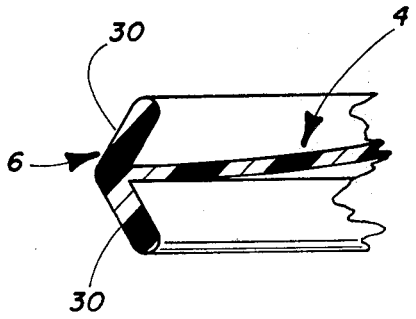
FIG. 6

REVERSIBLE FLEXIBLE AERODYNAMIC DISC

CROSS-REFERENCE TO RELATED APPLICATION

The present application is a continuation-in-part of copending Ser. No. 894,875, now abandoned, filed Apr. 10, 1978, by the inventor herein.

BACKGROUND OF THE INVENTION

This invention relates to an aerodynamic, disc-shaped object. More particularly, this invention relates to an aerodynamic disc-shaped object having utility as a projectile used in amusements, such as games of catch and the like.

It is well known in the prior art to provide a disc-shaped object having an outer rim section for utilization as an aerodynamic toy. Typical examples of such discs are found in U.S. Pat. Nos. 3,359,678 and 3,724,122. However, these latter patents do not disclose the strategic displacement of weight throughout the disc-shaped object.

Moreover, all of the patents that utilize the displacement of weights on an aerodynamic disc for trajectory purposes, employ this weight addition or displacement toward the periphery of the disc. For example, U.S. Pat. No. 3,673,731 discloses an aerodynamic disc and gyroscopic toy in which the disc preferably has its rim thickened to concentrate a large portion of the mass of the toy as far from the axis of rotation as is possible. Also, U.S. Pat. No. 3,828,466 discloses a flying saucer utilizing a rim which is thicker and has more weight thereon for stabilizing the flying saucer. U.S. Pat. No. 3,852,910 also discloses an aerial toy disc having airfoils thereon, wherein adjustable weights are attached to the peripheral ends of the airfoils to allow the user to change the lift to weight ratio. See also U.S. Pat. No. 4,023,805 in which the rim of a flying disc toy is eccentrically weighted.

The only U.S. Patent that disclosed an aerodynamic toy of a generally flat circular configuration, wherein the foam density in the center was slightly greater than at the peripheral regions, in U.S. Pat. No. 3,710,505. However, the central region in this latter patent is substantially large so as to encompass most of the aerodynamic toy. Additionally, the higher density in the central region only acts to retain the toy in a permanent convex configuration and not to increase the rotational spin of the toy.

In addition, no aerodynamic toy was found that conforms to an arcuate, cross-sectional configuration during airborne travel and which exhibits its concave side always facing down, independent of the side of the disc-shaped object that is facing down. U.S. Pat. No. 3,566,532 discloses a flying saucer type toy, the toy being of a disc-shaped configuration and having a rim section extending on both sides of the periphery of the disc-shaped saucer. However, the disc section of the toy includes strengthening vanes occupying a substantial height of the toy, resulting in a reduced air foil effect. Because of the thickness of the strengthening vanes and the rigidity caused thereby, resulting in a lack of an arcuate configuration like that shown in U.S. Pat. No. 3,359,678, there is a loss of accuracy and distance when the flying saucer type toy of this patent is thrown. In addition, this patent does not disclose the utilization of a substantial amount of the weight of the disc-shaped object at its center.

Accordingly, it is believed that the present invention solves the problem in the prior art of providing an aerodynamic disc-shaped object having increased rotational spin, wherein the aerodynamic disc-shaped object may be reversible.

SUMMARY OF THE INVENTION

In accordance with the present invention, an aerodynamic disc-shaped object is provided, comprising a disc, an outer rim section attached to the periphery of the disc, and a central section disposed within the center of the disc, wherein the central section comprises a substantial amount of the weight of the disc-shaped object for increasing the rotational spin of the object. The central section is also preferably of a magnetic material. In addition, the aerodynamic disc-shaped object may be reversible, wherein the disc is of a thin, flexible membrane and the rim section extends from both sides of the periphery of the disc, the rim section being of sufficient weight to create an arcuate, cross-sectional configuration in the disc-shaped object when the same is airborne and in which the disc-shaped object always exhibits its concave side facing down, independent of the side of the disc-shaped object that is facing down.

Accordingly, it is a principal object of the present invention to provide an aerodynamic disc-shaped object in which a substantial amount of the weight of the disc-shaped object is disposed at the center of the object for increasing the rotational spin of the object.

It is a further object of the present invention to provide an aerodynamic disc-shaped object in which the distance and accuracy of the desired trajectory are increased.

It is a still further object of the present invention to provide an aerodynamic disc-shaped object in which a substantial amount of the weight of the disc-shaped object is disposed within a central axis of the object.

It is a yet further object of the present invention to provide an aerodynamic disc-shaped object which is reversible.

It is another object of the present invention to provide an aerodynamic disc-shaped object in which the disc is of a thin, flexible membrane and the rim section extends from both sides of the periphery of the disc, the rim section being of sufficient weight to create an arcuate, cross-sectional configuration in the disc-shaped object when the same is airborne, independent of the side of the disc-shaped object that is facing down.

It is still another object of the present invention to provide an aerodynamic disc-shaped object which is reversible in which the disc always exhibits a concave configuration facing down, independent of the side of the disc-shaped object that is facing down.

It is yet another object of the present invention to provide an aerodynamic disc-shaped object which is inexpensive and easy to manufacture.

Further objects and advantages will become apparent to those skilled in the art from the ensuing description which proceeds with reference to the accompanying figures.

BRIEF DESCRIPTION OF THE DRAWINGS

FIG. 3 is a perspective view of a proposed reversible aerodynamic disc-shaped object of the present invention.

FIG. 4 is a corss-sectional view of the embodiment of FIG. 3 taken along line 4—4.

FIG. 5 is a partial side plan, cross-sectional view of another proposed rim section.

FIG. 6 is a partial side plan, cross-sectional view of another proposed rim section.

DESCRIPTION OF THE PREFERRED EMBODIMENTS

Figure 1:
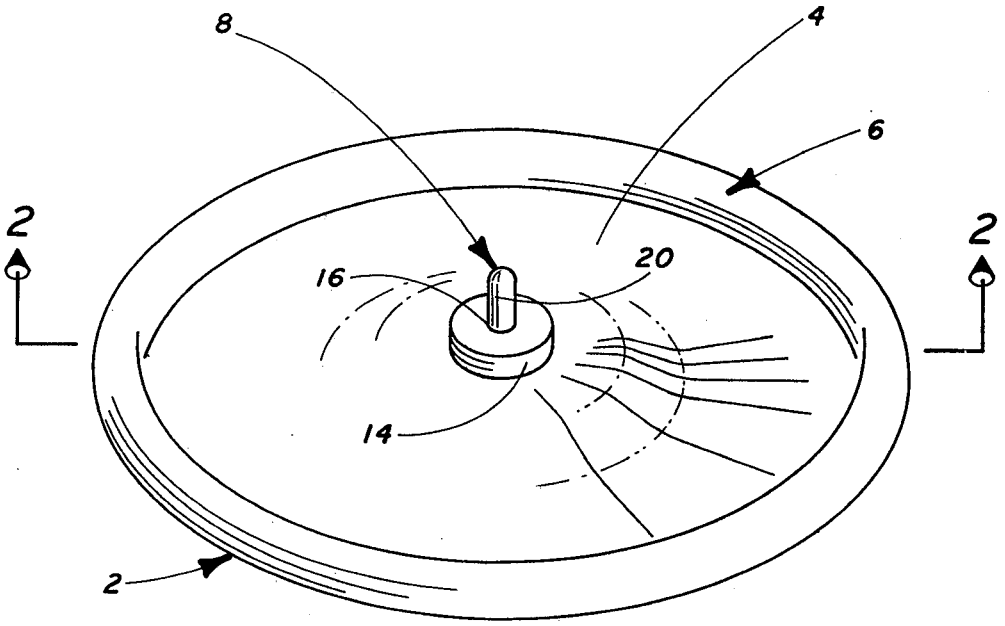
FIG. 1 is a perspective view of a proposed aerodynamic disc-shaped object of the present invention.

Referring to the drawings, wherein like numerals represent like parts, FIG. 1 represents an aerodynamic disc-shaped object 2 in accordance with the present invention, comprising a disc 4, an outer rim section 6 integrally formed with the periphery of disc 4, with the rim section extending from opposite sides of the horizontal plane of the periphery and a central section 8 having a central axis of rotation of the disc 4 disposed within disc 4 at the center thereof, wherein central section 8 comprises a substantial amount of the weight of object 2 for increasing the rotational spin of the disc-shaped object.

Figure 2:
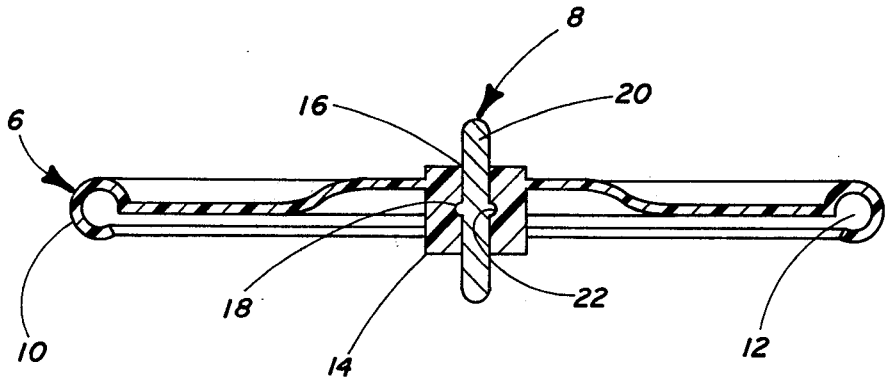
FIG. 2 is a cross-sectional view of the embodiment of FIG. 1 taken along line 2—2.

Referring to FIGS. 1 and 2, disc 4 is seen to possess a circular perimeter and a substantially planar or slightly curved cross-sectional configuration. Disc 4 may be made from any suitable material, but is preferably of a thin, flexible and durable plastic.

The rim section 6 is preferably a toroidal or donut-shaped configuration. As shown in FIG. 2, toroidal rim section 6 is partially open at any end cross-section 10. In this manner, an air pocket 12 is formed within toroidal rim section 6 to provide lift to object 2 when thrown. Additionally, the configuration of a toroidal rim section 6 adds some weight to rim 6, thus aiding in the stabilization of object 2, to be later discussed. However, it is to be noted that any suitable outer rim section 6 may be utilized in conjunction with the present invention, e.g., such as the rim section utilized in U.S. Pat. No. 3,359,678.

Referring to FIGS. 1 and 2, one embodiment of central section 8 of the present invention is disclosed. Central section 8 includes a central core 14 integrally attached near its upper end to disc 4 at the center thereof. As shown in FIG. 2, central core 14 includes a central bore 16 having a circular groove 18 therein.

Referring to FIG. 2, central section 8 comprises a central axis 20, axis 20 being preferably of a rod-like, cylindrical configuration and providing a substantial amount of the weight of object 2. Additionally, central axis 20 includes a circular detent 22 thereon corresponding to groove 18 of central bore 16. In this manner, central axis 20 may be removably secured within bore 16 of central core 14. Alternatively, central axis 20 may be secured within bore 16 in any suitable manner such as pressfitting or the like. Referring to FIG. 2, central axis 20 extends from both ends of bore 16, thus providing added stability to object 2 during its trajectory. In its preferred embodiment, central axis 20 is of a magnetized material and comprises 80 percent of the weight of object 2.

Alternatively, it is seen that any suitable central section 8 may be utilized wherein central section 8 comprises a substantial amount of the weight of object 2 for increasing the rotational spin of the disc-shaped object. For example, central core 14 may be molded as a continuous cylinder without bore 16 and of a denser material than disc 4. It is to be noted that disc-shaped object 2 is useful with a particular device for catching and throwing disc-shaped object 2 disclosed in copending Ser. No. 847,072, now U.S. Pat. No. 4,153,252, by Richard A. Sullivan, et al.

It is thus seen that the combination of a substantial amount of the weight of object 2 at its center in conjunction with a toroidal rim section 6, in which the rim 6 provides some weight at the periphery of object 2 and forms air pockets therein, results in a disc-shaped object 2 having maximum rotational spin and stability. This result can be seen from the viewpoint of classical physics, e.g., when two discs of the same weight have equal energy imparted to them, the disc with the lower rotational inertia will have a greater angular spin. This latter result is due to the fact that the kinetic energy of an object is equivalent to one-half the rotational inertia times the square of the angular velocity. More particularly, since rotational inertia is equivalent to the sum of all mass points times the square of the radius of such points, if two discs have equivalent weight but varying displacement thereof, the disc having its weight closer to the center will have a lower rotational inertia and thus will spin faster than the other disc when the same energy is imparted to both discs. In this manner, a disc-shaped object 2 with its weight at the center will travel further than another disc of equivalent weight.

In addition, aerodynamic disc-shaped object 2 may be reversible such that object 2, while airborne, always forms a concave side facing down, independent of the side of the disc-shaped object that is facing down. Referring to FIG. 4, disc 4 is shown to be of a thin, flexible membrane. For example, disc 4 may be manufactured from a thin, flexible and durable plastic of 3/32 inch cross-sectional height. In utilizing the reversible object 2, disc 4 is preferably integrally attached around central core 14 at the center thereof. However, the invention is not limited to the attachment of disc 4 around central core 14 at the center thereof, and may be attached at any suitable circumferential height on core 14, such as shown in FIG. 2.

In utilizing reversible disc-shaped object 2, rim section 6 preferably extends from both sides of the periphery of disc 4. As shown in FIGS. 3 and 4, rim section 6 may be of a cylindrical shape, having a planar, cross-sectional configuration extending at right angles from the periphery of both sides 24 and 26 of disc 4. In addition, rim section 6 is of sufficient weight to create an arcuate, cross-sectional configuration in object 2 during its airborne travel, rim section 6 being at the lower most end of the arcuate configuration. However, it is to be noted that rim section 6 is not of sufficient weight to substantially interfere with the increased rotational spin of object 2 due to the substantial amount of weight of object 2 at its center. In this manner, it can be seen that object 2, and particularly disc 4, always exhibits a concave side facing down during airborne travel, independent of the side 24 or 26 of object 2 that is facing down. It is to be noted that any suitable rim section 6, in conjunction with the present invention, may be utilized. For example, as shown in FIG. 5, rim section 6 may include circular inturned flanges 28 at the ends of cylindrical rim section 6. Another example is shown in FIG. 6 in which rim section 6 includes two cylindrical members 30, an end of each member 30 being an integrated part of the periphery of disc 4, each member 30 having a planar, cross-sectional configuration which is formed at the periphery of disc 4 at an acute angle therewith.

In all of the above examples, it is to be noted that rim section 6 extends from both sides 24 and 26 of the periphery of disc 4. This results in a reversible aerodynamic disc-shaped object 2 which will have an identical performance regardless of which side is facing down. However, any modification within the scope of the claims may be made. For example, rim section 6 on one side 24 or 26 of disc 4 may extend further from or be of a different configuration than that part of rim section 6 extending from the opposite side. In this manner, a reversible aerodynamic disc is provided which has different airborne characteristics depending on the side that is facing down, but always exhibits its concave side facing down.

As shown in FIG. 4, equal extension of the rim section 6 at right angles to the centerline of the disc 4 in a horizontal plane results in a development of an equal lift of the disc regardless of which side is facing down.

Figure 7:
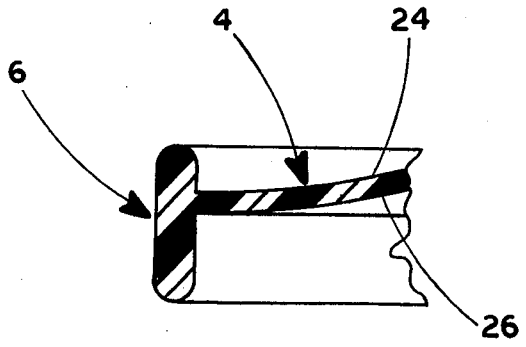
FIG. 7 is a cross-sectional view of another embodiment of FIG. 3 taken along line 4—4 illustrating another proposed rim section.

As shown in FIG. 7, unequal extension of the rim section 6 at right angles to the centerline of the disc 4 in a horizontal plane results in a development of different lift of the disc at a different velocity depending upon which side of the rim is facing down. When a larger extension of the rim section 6 is facing downward, the disc will travel at high lift and less velocity. Further, when a smaller extension of the rim section 6 is facing downward, the disc will travel at lower lift and higher velocity with respect to the disc having a larger extension of the rim section 6 facing downward. Thus, said reversible aerodynamic disc can be thrown two ways as described hereinbefore, as one desires. This type of disc having unequal extension of the rim as shown in FIG. 7, adds great amusement among the players playing said disc. A main advantage of said disc is that it is moldable and, thus, it is easy to manufacture in a large quantity at a reduced cost.

It is to be understood that the invention is not limited to the illustrations described and shown herein which are deemed to be merely illustrative of the best modes of carrying out the invention, and which are suitable of modification of form, size arrangement of parts, and details of operation. The invention rather is intended to encompass all such modifications which are within the spirit and scope as defined by the claims.

I claim:

1. A reversible aerodynamic disc-shaped object, comprising:

(a) a thin, flexible disc;

(b) a central section having a central axis of rotation of said disc, disposed within the center of said disc, said section comprising a substantial amount of the weight of said disc-shaped object; and (c) an outer rim section integrally formed with the periphery of said disc, said rim section extending from opposite sides of the horizontal plane of said periphery, said rim section comprising sufficient weight to create an arcuate, cross-sectional configuration in said disc-shaped object when said object is airborne, wherein said object exhibits a concave configuration facing down independent of the side of said object that is facing down.

2. The aerodynamic disc-shaped object of claim 1 wherein said rim section is of a cylindrical shape having a planar, cross-sectional configuration extending at right angles from the periphery of both sides of said disc.

3. The aerodynamic disc-shaped object of claim 2 wherein said rim section includes circular inturned flanges at the ends of said cylindrical rim section.

4. The aerodynamic disc-shaped object of claim 1 wherein said rim section includes two cylindrical members, one end of each member being attached at the periphery of said disc, each member having a planar, cross-sectional configuration which is attached to said periphery at an acute angle therewith.

5. The aerodynamic disc-shaped object of claim 1, wherein said central section comprises a central axis.

6. The aerodynamic disc-shaped object of claim 5, wherein said central axis comprises a majority of the weight of said object.

7. The aerodynamic disc-shaped object of claim 6, wherein said central axis comprises 80 percent of the weight of said object.

8. The aerodynamic disc-shaped object of claim 5, wherein said central axis is of a magnetic material.

9. The aerodynamic disc-shaped object as recited in claim 1, wherein said rim section is equally extended at right angles to a centerline of the disc in a horizontal plane, resulting in an equal lift independent of the side of said object that is facing down.

10. The aerodynamic disc-shaped object as recited in claim 1 wherein said rim section is unequally extended at right angles to a centerline of the disc in a horizontal plane, resulting in different velocity and lift depending upon which side of said rim is facing down.

* * * * *